United States Patent [19]

Sumita

[11] 4,205,924

[45] Jun. 3, 1980

[54] MECHANICAL PENCIL WITH LEAD-FEEDING DEVICE OPERABLE BY FORWARD SHAKE OF PENCIL

[75] Inventor: Yo Sumita, Machida, Japan

[73] Assignee: Pilot Precision Kabushiki Kaisha, Hiratsuka, Japan

[21] Appl. No.: 961,506

[22] Filed: Nov. 17, 1978

[51] Int. Cl.[2] ..... B43K 21/16

[52] U.S. Cl. ..... 401/65; 401/67

[58] Field of Search ..... 401/55, 57, 65, 67, 401/93, 94

[56] References Cited

U.S. PATENT DOCUMENTS

| | | | |
|---|---|---|---|
| 2,158,991 | 5/1939 | Stenersen | 401/65 |
| 2,385,329 | 9/1945 | Buchanan | 401/65 |
| 2,492,839 | 12/1949 | Bovbaker | 401/67 |
| 2,561,113 | 7/1951 | Hallberg | 401/65 |

*Primary Examiner*—Edward M. Coven

*Attorney, Agent, or Firm*—Wenderoth, Lind & Ponack

[57] ABSTRACT

A lead-feeding mechanism comprising a lead reservoir, a connector, and a chuck in a mechanical pencil is held by a front spring in a normal rear position, at which the chuck is clamping a lead piece, but when a forward shake is imparted to the pencil, a weight collides forwardly with the lead-feeding mechanism and pushes the same forward, counter to the force of the spring, whereupon the chuck feeds the lead piece through a specific distance then releases the same, the lead-feeding mechanism being subsequently returned by the spring to the normal position, where the chuck again clamps the lead piece at a new position thereof.

18 Claims, 12 Drawing Figures

MECHANICAL PENCIL WITH LEAD-FEEDING DEVICE OPERABLE BY FORWARD SHAKE OF PENCIL

BACKGROUND OF THE INVENTION

This invention relates generally to mechanical pencils and more particularly to a mechanical pencil which operates, each time it is subjected to a forward shake in the axial direction of the barrel or holder, to feed or project a pencil lead by a specific distance out through the writing end of the pencil.

Throughout this disclosure, the writing end of the pencil and the other end thereof are respectively referred to as the "front" and "rear" ends, and, correspondingly directions toward these ends are respectively referred to as "forward" and "rearward".

Known mechanical pencils have generally been of the rotating type or the "knocking", or knob-pressing, type. These types require troublesome manipulations for feeding out the lead for replenishment. For example, when the lead of a known mechanical pencil, held in a writer's hand for writing, becomes short and must be further projected forward, the lead-feeding procedure entails the steps of regrasping the pencil by one or two hands, rotating one part of the pencil or pushing a knob, and regrasping again the pencil for writing. These manipulative steps are extremely inefficient. In a known mechanical pencil, furthermore, the wedge-shaped part of a chuck for clamping the lead is pressed into a tightening ring by the elastic force of a front spring and is thereby forced by the wedge action to clamp and hold a piece of lead.

For this reason, unless this state of the lead held only by elastic force of the front spring is amply secure, that is, unless the initial lead holding force is amply great, the lead cannot be positively held since additional lead holding force cannot be obtained from the writing force, that is, the reaction force of the writing surface on the lead. Accordingly, the improvement of the chuck performance for assuring ample initial lead holding force has heretofore been a difficult problem. For this reason, a load on the front spring at the time of its installation of more than approximately 500 grams has been absolutely necessary, and even with this great installation load, problems have remained.

Furthermore, this installation load of the front spring has, in addition to its relationship to the initial lead holding force, a close relationship also to the balancing thereof with the pressing force of the eraser rubber arising from the use of the eraser rubber. As a result of our study directed toward the solutions of these problems, we have found that, by fabricating the chuck so that it has greater flexibility and improving the fabrication precision of the tightening ring, these problems can be overcome, and, moreover, by reducing the installation load of the front spring relative to those used heretofore, an initial lead holding force of ample magnitude can be obtained.

As a result of further study, we have succeeded, by further lowering the installation load of this front spring, in providing a mechanical pencil in which the lead can be progressively fed by merely utilizing the momentum of a weight member without carrying out rotating or "knocking" manipulation.

The reason for the necessity of a very low installation load of the front spring is that the required weight of the weight member whose momentum is utilized for feeding the lead increases as the installation load of the front spring increases, whereby a large load gives rise to a large total weight of the pencil, which would be highly undesirable.

SUMMARY OF THE INVENTION

It is an object of this invention to provide a mechanical pencil of relatively simple construction in which the pencil lead can be fed out by a specific distance for replenishment by merely imparting a forward shake to the pencil barrel or holder in the axial direction thereof. By this feature of the pencil, the lead can be thus fed with a natural, efficient, single-hand motion with the pencil held in the normal writing position in the writing hand throughout the lead-feeding operation, whereby lead feeding can be accomplished with minimum period of interruption of writing and train of thought.

Another object of the invention to provide a guide tube for protecting the projecting lead at the front writing end of the pencil, which guide tube projects beyond the forward end of the pencil by a specific distance affording convenience in use, particularly in drawing lines by means of a ruler or curve guide. The invention also provides a modified guide tube which is slideable in the axial direction and is projected forward with the lead whenever the lead is fed out and is retracted progressively rearward as the lead is consumed. By this feature, the lead can be fed by a relatively long distance with each lead feeding motion without the risk of lead breakage.

Still another object of the invention is to provide a mechanical pencil having a chuck with an elastic spring part of great flexibility, which, in combination with a precision ring, affords a great reduction of the installation load of a front spring while still providing an initial lead holding force of ample magnitude of the chuck.

A further object of the invention is to provide, in a mechanical pencil of the above stated character, shock-absorbing members suitably disposed and adapted to reduce vibration and noise due to the impact of a weight in the operation of feeding the lead by imparting a forward shake to the pencil.

An additional object of the invention is to provide, in a mechanical pencil of the above stated character, means for preventing unintentional feeding of the lead due to unavoidable vibration occurring when the pencil is being carried on one's person, for example.

According to this invention in its basic form, briefly summarized, there is provided a mechanical pencil having a barrel or holder cylinder with a hollow front nose piece and characterized by a pencil lead feeding device contained within the holder cylinder and comprising: a tubular lead reservoir adapted for storing therein lead pieces to be successively fed forward and being secured at its front end to the rear part of a chuck which is adapted to clamp and release a lead piece thus fed upon being moved respectively rearward and forward relative to a tightening ring, and which, together with the lead reservoir, constitutes a central lead-feeding mechanism; a front spring with an installation load of less than 200 grams urging the lead-feeding mechanism rearward into a normal position at which the chuck is clamping the lead piece; and a weight associated with the lead-feeding mechanism to move the same forward, overcoming the force of the front spring, when a forward shake is imparted to the holder cylinder, whereby the chuck feeds the lead piece forward by a specific distance until it is caused to release the lead piece, the lead-feeding mechanism then being returned to its normal position by the front spring.

The nature, utility, and further features of this invention will be apparent from the following detailed description when read in conjunction with the accompanying drawings, which are briefly described below, and throughout which like parts are designated by like reference numerals.

DETAILED DESCRIPTION

Figure 1:
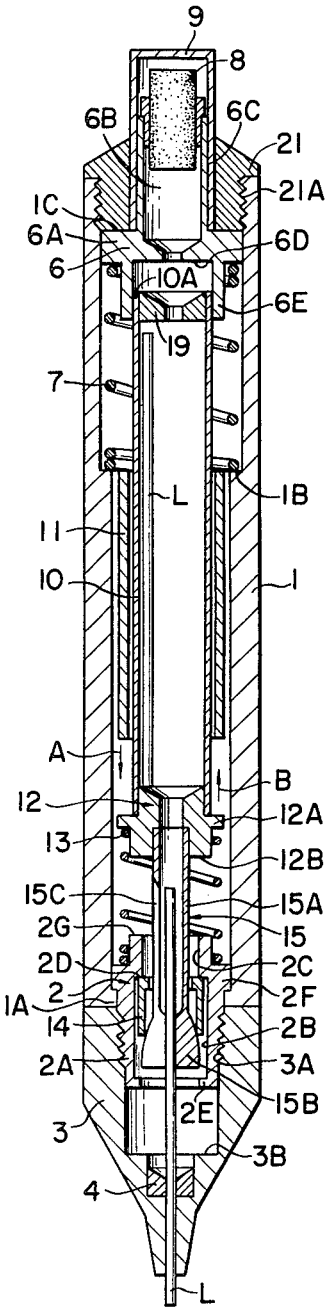
FIG. 1 is a side view, in longitudinal section, showing an example of the essential construction of the mechanical pencil of this invention in its basic form.

Referring first to FIG. 1, the mechanical pencil according to this invention shown therein has an outer casing or holder cylinder 1 having at its front end a front internal flange 1A, in and against which a nipple connector 2 is coaxially fitted. This nipple connector 2 has a hollow interior and an externally threaded part 2A extending forward from the end of the holder cylinder 1 and screw engaged with internal threads 3A formed at the rear end of a nose piece 3, which is thereby connected securely and coaxially to the front end of the cylinder 1. The nose piece 3 has a rear cylindrical part of the same outer diameter as the cylinder 1 and a convergently tapering or pointed front writing end, which houses a lead holder 4 for lightly holding a pencil lead L.

At a point intermediate between its front and rear ends, the cylinder 1 has an internal stepped part or shoulder 1B facing rearward and, near its rear end, has a rear stop shoulder 1C facing forward. An eraser rubber holder 6 of generally cylindrical shape with a flange part 6A is pressed at its flange part 6A against the stop shoulder 1C by a compression rear spring 7 abutting at its front end against the shoulder 1B and at its rear end against the front face of the flange part 6A of the eraser holder 6. This eraser holder 6, which, at its flange part 6A, is slidably fitted in the holder cylinder 1, holds an eraser rubber 8 fitted into the rear part of its hollow interior 6B. A knob 9 of hollow cup shape is fitted onto the outer surface 6C of the eraser holder 6 at its rear end in a manner to cover the eraser rubber 8. This knob 9 is pulled off toward the rear for erasing, during which the eraser rubber, held by its holder 6, is prevented by the force of the above mentioned rear spring 7 from sinking into the holder cylinder 1.

Furthermore, the eraser holder 6 is provided with an internal shoulder 6D facing forward and a front cylindrical part 6E. Into the forward end of the front cylindrical part 6E is inserted the rear end 10A of a cylindrical lead reservoir 10, the extreme rear face of the rear end 10A being normally spaced apart by a small distance from the internal shoulder 6D. The front end of the lead reservoir 10 is fitted around and secured to the rear end of a connector 12 having a flange 12A.

A cylindrical weight 11 having an inner diameter slightly greater than the outer diameter of the lead reservoir 10 and an outer diameter less than the inner diameter of the holder cylinder 1 is disposed between the lead reservoir 10 and the holder cylinder 1 and is of a length permitting it to slide axially between the flange 12A of the connector 12 and the extreme front face of the front cylindrical part 6E of the eraser holder 6. Moreover, this weight 11 is of a weight quantity such that the lead reservoir 10 moves axially in the arrow direction A forward overcoming the elastic force of a compression front spring 13 disposed between the connector flange 12A and a flange part of the aforedescribed nipple 2. A chuck 15 for releasably holding the pencil lead L comprises a tubular part 15A and a wedge-shaped head part 15B for chucking the lead L. The rear end of the tubular part 15A is fixedly secured to the connector 12. A slit 15C is cut in the tubular part 15A and the head part 15B as is known in the art. While it is possible for the chuck 15 to hold the pencil lead L even when the load under which this front spring 13 is assembled is of the order of 1 gram (g.) depending on the thickness of the wall of the tubular part 15A and the length of the slot 15C of the chuck, a spring preload of the order of 50 to 150 g. is particularly preferable.

The nipple 2 is provided at its forward part with a sliding bore 2B for a tightening ring 14 and at its rear part with a bore 2C having a smaller diameter than the bore 2B for passage therethrough of the tubular part 15A of the chuck 15 and communicating with the sliding bore 2B, an engagement shoulder 2D facing forward thereby being formed at the juncture of these two bores of different diameters. The tightening ring 14 is slidably disposed within the sliding bore 2B and around a portion of the wedge-shaped head part 15B of the chuck 15. The head part 15B is caused to clamp the pencil lead L when it is forced against the tightening ring 14. The tightening ring 14, when sliding forward in this state wherein the chuck is clamping the lead L, is prevented from sliding out of the front end of the nipple 2 by a front internal shoulder 2E of the nipple. Accordingly, each time the tightening ring 14 is caused to slide from the engagement shoulder 2D to the front shoulder 2E, the pencil lead L is fed out by a specific amount.

The chuck 15 is secured at its rear end to the connector 12, as described hereinbefore. Thus, the chuck 15, the tightening ring 14, the connector 12, and the lead reservoir 10 constitute a lead-feeding mechanism. This mechanism is urged to move in the arrow direction B (rearward) by the elastic force of the above mentioned front spring 13 compressed between an external flange 2F of the nipple 2 and the flange 12A of the connector 12. As a consequence, the chuck head part 15B at the front end of this mechanism is forced toward the interior of the tightening ring 14 and thereby caused by the resulting wedge action to clamp the lead L.

For facility in assembly of the mechanical pencil unit, the rear end thereof may be closed by a rear plug 21 secured to the holder cylinder 1 by screw threads 21A meshed with internal screw threads formed in the holder cylinder 1.

The mechanical pencil of the above described construction according to this invention is operated in the following manner. When lead feeding is to be carried out for writing, the entire pencil is given a shake in the direction A (forward), whereupon the weight 11 disposed around the lead reservoir 10 strikes with impact force against the flange 12A of the connector 12. As a consequence, the aforedescribed lead-feeding mechanism shifts forward, and the lead L is fed by a specific length.

This mechanical operation will be further considered in greater detail. First, as a consequence of the mechanical pencil being subjected to a shake in the forward direction, the weight 11 initially moves rearward relative to the other parts of the pencil because of inertia and collides with the front cylindrical part 6E of the eraser rubber holder 6. Then, as a result of the reaction due to this collision and the momentum imparted by the forward movement of the pencil, the weight 11 strikes against the flange 12A of the connector 12 constituting a part of the above mentioned lead-feeding mechanism, which is thereby caused to shift forward, overcoming the elastic force of the front spring 13.

Accordingly, the head part 15B of the chuck 15 at the front end of the lead-feeding mechanism, still in the state of being constricted by the tightening ring 14, that is, its state of clamping the lead L, moves forward, overcoming the light holding force or friction of the lead holder 4 disposed within the nose piece 3, until the tightening ring 14 strikes against the front internal shoulder 2E of the nipple 2 and stops after it has thus move forward through a specific distance. However, the lead-feeding mechanism continues to move forward, whereupon the head part 15B of the chuck 15 disengages forwardly from the tightening ring 14, thereby being released from the constriction of the tightening ring 14. The chuck 15 thereupon opens laterally because of its elastic force and releases the lead L, which is then lightly held only by the lead holder 4.

Figure 2:
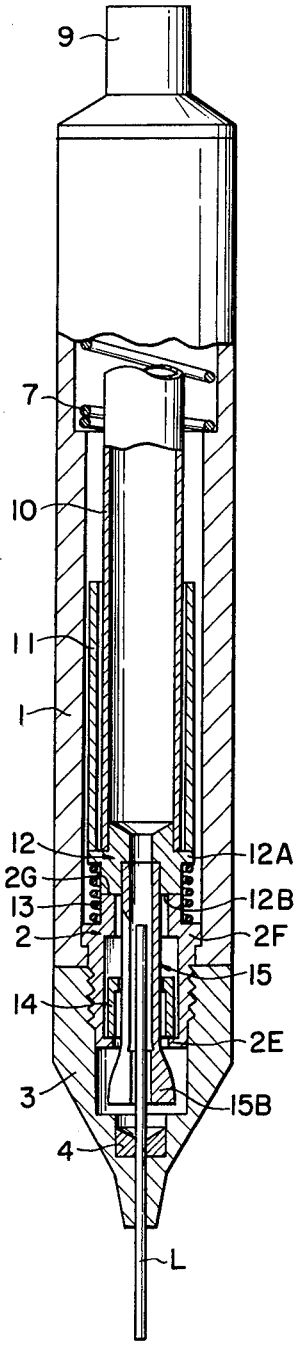
FIG. 2 is a view similar to FIG. 1 but showing a state of the pencil wherein the lead has been fed out.

Soon after the lead L is thus released, the front end 12B of the connector 12 abuts against the rear end 2G of the nipple 2 as shown in FIG. 2, whereby the forward movement of the lead-feeding mechanism is stopped. The front spring 13 installed between the flange 12A and the external flange 2F of the nipple 2 is now under its maximum compression. The spring force of this front spring 13 then returns the lead-feeding mechanism rearward, and this action forces the wedge-shaped head part 15B of the chuck 15 into the tightening ring 14. The resulting wedge action, as described hereinbefore, causes the chuck 15 to clamp again the lead L, whereupon one cycle of feeding of the lead L by a specific length thereof is completed. Whenever the forward tip of the lead L has been consumed by writing and the lead needs to be fed again, the above described operation is repeated.

As one piece of lead L is thus successively fed forward, its rear end also shifts forward and is followed by the front end of the succeeding piece of lead supplied from the lead reservoir 10. When the first piece of lead L is nearly used up, the front end of the succeeding piece of lead is also clamped by the chuck 15. In order to ensure positive following up of the succeeding pieces of lead even when there is a vibration due to the aforedescribed colliding action of the weight 11, by cylindrical lead reservoir 10 is provided at its rear end with a stopper structure 19 (FIG. 1) having a lead insertion hole of a diameter slightly greater than the diameter of the lead. Thus, the distance through which the pieces of lead stored in the lead reservoir are flung rearwardly is shortened.

The wall thickness of the tubular part 15A of the chuck 15 is preferably made thin so as to increase the flexibility of the chuck. In addition, the spring constant of the front spring 13 and its installation load are made small so that it will be deflected by the force due to the momentum of the weight 11. For this reason, the front end 12B of the connector 12 is caused to abut against the rear end 2G of the nipple 2 as described above prior to the abutting of the front end of the chuck 15 against the inner shoulder 3B of the nose piece 3 and prior to the full compression of the front spring 13, thereby to prevent deterioration or damaging of the chuck 15 and the front spring 13 and to assure reliable performance.

Figure 3:
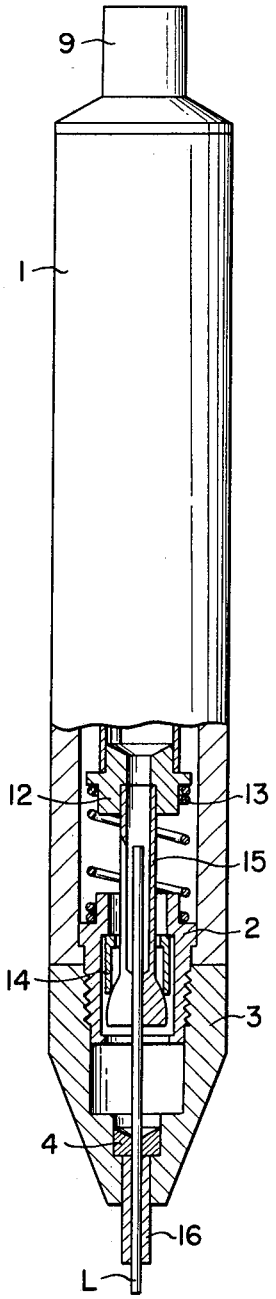
FIG. 3 is a similar side view of the same mechanical pencil provided with a guide tube fixed to the nose piece of the pencil.

In an example of the mechanical pencil of this invention as illustrated in FIG. 3, a guide tube 16 is secured to the front end of the nose piece 3 and projects by a suitable length beyond the front tip of the nose piece 3. For example, a guide tube 16 of a projecting length which is slightly greater than the thickness of ordinary rulers for drafting is highly convenient and useful for specialists such as draftsmen in drawing lines.

Figure 4:
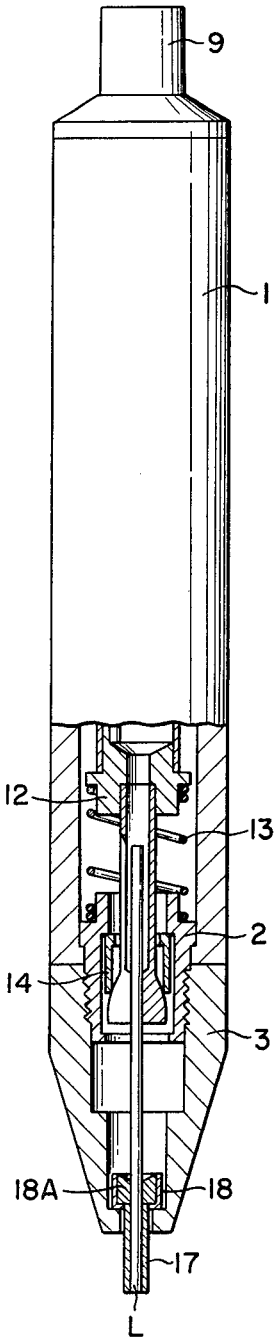
FIG. 4 is a similar side view of the mechanical pencil shown in FIG. 1 which is further provided with a movable guide tube integrally provided with a slide member.

In a modification of the structure of the guide tube as shown in FIG. 4, a guide tube 17 is fixed at its rear end to a slide member 18 having a lead holder 18A therein and slidably held within the nose piece 3. Simultaneously with the forward feeding of the lead L due to a forward shake of the pencil, the slide member 18 is caused to slide forward, and the guide tube 17 integral with the slide member 18 is also thrust forwardly out of the nose piece 3. By this construction, the guide tube 17 retracts progressively toward the rear as the lead L is consumed by writing, whereby the amount of writing, or writing distance, afforded by one feeding motion of the aforementioned lead-feeding mechanism can be made relatively great without the risk of breakage of the lead.

Figure 5:
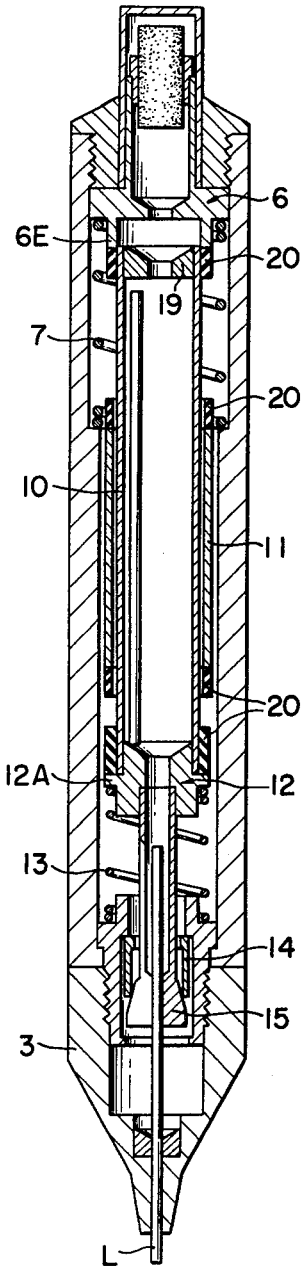
FIG. 5 is a similar side view of the mechanical pencil shown in FIG. 1 which is further provided with shock-absorbing materials for reducing vibration and noise due to impact action of a weight for feeding lead.

In a modification of the mechanical pencil according to this invention as illustrated in FIG. 5, shock-absorbing members 20 made of one or more resilient materials such as rubber are suitably disposed to reduce vibration and noise due to the impact action of weight 11 in the operation of feeding the lead L. For example, shock-absorbing members 20 are provided in the form of an annular ring on the rear face of the flange 12A of the connector 12, the front end of the front cylindrical part 6E of the eraser rubber holder 6, and one end or both ends of the weight 11.

These shock-absorbing members 20 function not only to absorb vibration and noise but also to afford smooth and positive follow-up of the following lead piece relative to the preceding lead piece. More specifically, the shock-absorbing function of these shock-absorbing members 20 has the effect of slightly prolonging the opening time of the chuck 15, and this effect, in combination with the effect of the stopper structure 19 at the rear end of the lead reservoir 10 in reducing the distance through which the lead pieces in the lead reservoir 10 are flung rearward when the pencil is subjected to a forward shake, positions the following lead piece just at the part of the chuck head part 15B of the chuck 15 for holding the lead at the time of opening of the chuck. Thus, when the preceding lead piece is about to be used up, the feeding of the succeeding lead piece is positively started.

Figure 6:
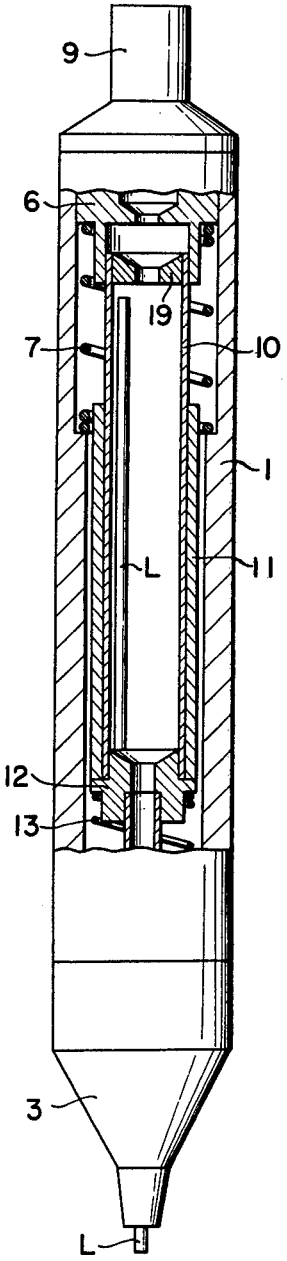
FIG. 6 is a side view, in longitudinal section, showing a modification wherein the weight for lead feeding action is fixed to the lead reservoir.

Vibration and noise due to the impact action of the weight 11 can be further reduced by fixedly securing the weight 11 to a part of the lead-feeding mechanism such as, for example, the lead reservoir 10 as shown in FIG. 6. Another effective method for this purpose is to adapt the lead reservoir 10 to function as the weight 11.

Figure 7:
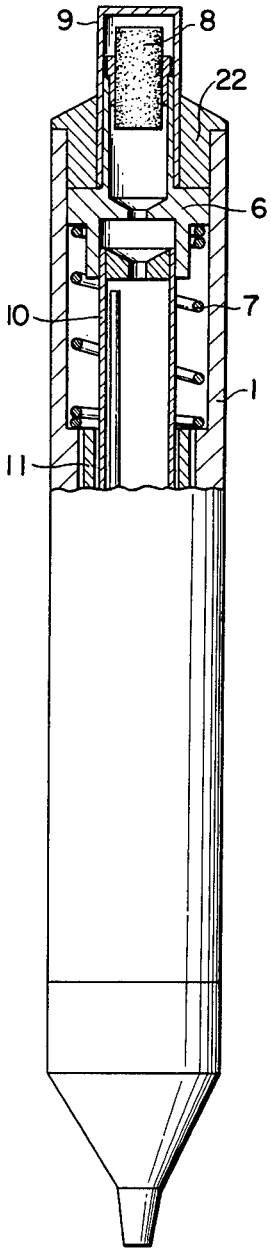
FIG. 7 is a partial side view, in longitudinal section, showing a modified rear plug for closing the rear end of the pencil holder and retaining the eraser rubber holder under a rearward force due to a rear spring.

In a modified form of the mechanical pencil shown in FIG. 7, a rear plug 22, similar to the plug 21 shown in FIG. 1, is secured to the holder cylinder 1 by press fitting or by means such as an adhesive. In either case the rear plug is secured in a manner to withstand the force of the rear spring 7 thereby to prevent the eraser rubber holder 6 from moving rearward past its rear limiting position.

Unintentional feeding of the lead due to unavoidable vibration occurring when the pencil is being carried on one's person, for example, is prevented in still other modifications of the mechanical pencil of this invention as illustrated in FIGS. 8 through 10 and FIGS. 11 and 12.

Figure 8:
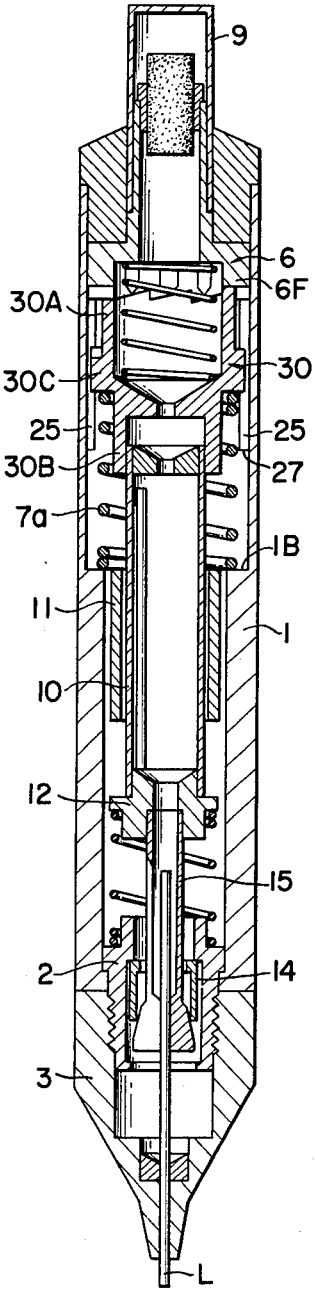
FIG. 8 is a view similar to FIG. 1 showing another example of the pencil according to the invention having a cam mechanism for pressing against and locking a lead-feeding mechanism thereby to place the chuck in lead-release state.
Figure 10:
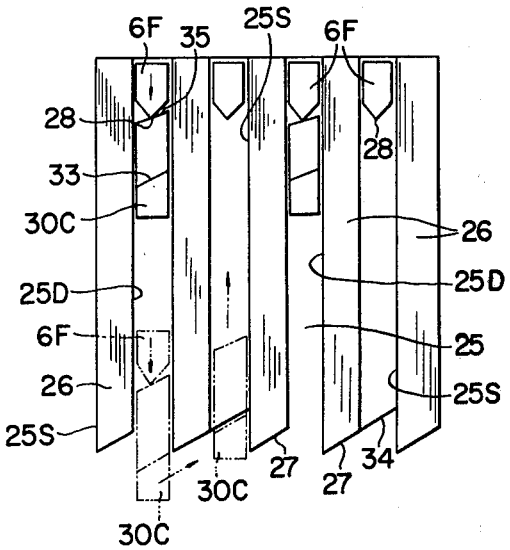
FIG. 10 is a development of the inner wall of the holder cylinder shown in FIGS. 8 and 9, illustrating the relationship of cam grooves and cam teeth.

In the pencil shown in FIG. 8, parallel cam grooves 25 are provided in the inner wall of the holder cylinder 1. These cam grooves 25 extend in the longitudinal direction of the holder cylinder 1 and are defined by parallel lands 26 each of which has an slanted face 27 at the forward end thereof, as shown in FIG. 10. The cam grooves 25 are made up of deep and shallow grooves 25D and 25S which are arranged alternately. The eraser rubber holder 6 is formed on the outer side surface thereof with a series of cam teeth 6F equi-distantly spaced apart along the periphery of the holder, each of the teeth 6F being in slidable engagement with one cam groove 25 as shown in FIG. 10 and having an engagement edge 28 at the front end thereof.

Forwardly of the eraser rubber holder 6 there is provided a rotary cam 30 in the form of a cylinder. The rotary cam 30 is made up of a rear cylindrical section 30A and a front cylindrical section 30B. Within the hollow interior of the rear section 30A, there is disposed a compression spring 31 for urging the eraser rubber holder 6 rearward. The front section 30B is in slidable engagement with the lead reservoir 10. A compression rear spring 7a similar to the rear spring 7 shown in FIG. 1 is disposed between the shoulder 1B and the forward end of the rear section 30A to urge the rotary cam 30 against the eraser rubber holder 6. The force of the spring 7a is stronger than that of the spring 31, so that the holder 6 and the rotary cam 30 are normally held in the positions shown in FIG. 8.

The rotary cam 30 is formed on the outer side surface thereof with a series of cam teeth 30C spaced apart along the periphery of the cam 30 and being of half the number of the above mentioned cam teeth 6F. Each of the cam teeth 30C has a slanted rear cam surface 33. The rear end of the rear section 30A of the rotary cam 30 is formed with a series of slanted cam surfaces 35 which are normally kept in contact with the respective engagement edges 28 by the action of the spring 7a.

The cam teeth 6F of the eraser rubber holder 6 are of such a radial dimension as to be slidingly movable in both the deep and shallow grooves 25D and 25S, while the cam teeth 30C of the rotary cam 30 are of such a radial dimension as to be incapable of slidingly moving into the shallow grooves 25S but capable of slidingly moving into the deep grooves 25D. As shown in FIG. 10, each shallow groove 25S terminates at its forward end at a slanted shoulder 34 forming a continuation of the adjoining slanted face 27.

When the knob 9 is depressed into the holder cylinder 1, the eraser holder 6 is moved forward, whereby the cam teeth 6F of the holder located within the deep grooves 25D press and move forward the rear section 30A and hence the cam teeth 30C of the rotary cam 30 along the deep grooves 25D. As the cam teeth 6F move forward to such a position as to cause the cam teeth 30C to move out of the grooves 25D, the rotary cam 30 and hence the cam teeth 30C thereon are caused to rotate in a clockwise direction as viewed from above to below in FIGS. 8 and 9 or to move to the right as viewed in FIG. 10 under the guidance of the slanted faces 27 so as to finally engage the slanted shoulders 34 of the shallow grooves 25S, as indicated in chain lines in FIG. 10, because the cam teeth 30C are imparted a sidewise force urging the same to the right as viewed in FIG. 10 due to the forward pressing force acting on the slanted cam surfaces 35. It will be understood that the cam teeth 30C engaging the shoulders 34 cannot move rearward into the shallow grooves 25S because of the radial dimension thereof. Thus, the cam teeth 30C and hence the rotary cam 30 are kept arrested or locked in the forward position shown in FIG. 9 even after the knob 9 has been released and returned to its normal position.

Figure 9:
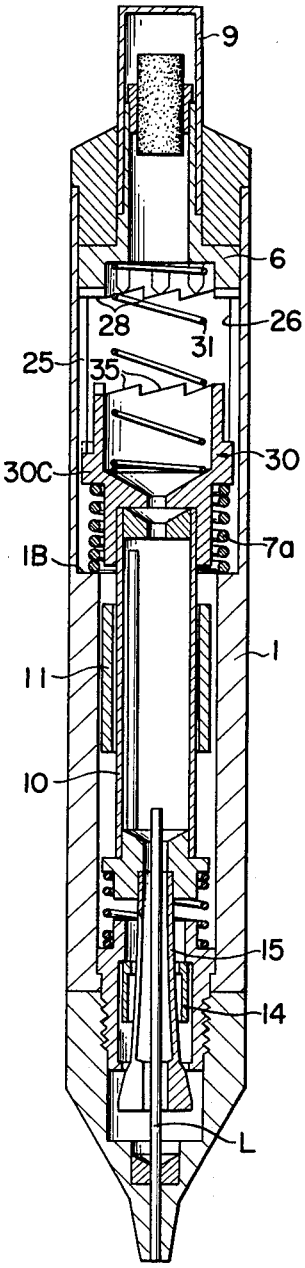
FIG. 9 is a similar view of the same pencil in the state wherein the lead-feeding mechanism has been pressed forward and locked, whereby the chuck is in its lead-release state.

With the rotary cam 30 locked in the forward position shown in FIG. 9, the lead-feeding mechanism including the lead reservoir 10 and the chuck 15 are kept in the advanced position shown in FIG. 9 in which the chuck 15 is freed from the tightening ring 14 to spread open and be locked in the opened state. By leaving the lead-feeding mechanism in this state, feeding of the lead L when the pencil is not being used is prevented, and, at the same time, there is no possibility of the lead breakage since the chuck 15 is not holding the lead.

When the pencil is to be used, the knob 9 is depressed until the cam teeth 6F are moved, pressing the rotary cam 30 forward, to a position in which the cam teeth 30C of the rotary cam 30 are shifted forward out of the engagement with the shoulders 34. As the cam teeth 30C are moved forward beyond the slanted faces 27, the teeth 30C are shifted to the right as viewed in FIG. 10 due to the sidewise force acting on the rotary cam 30, and moved obliquely rearwardly along the faces 27, moving further rearwardly into and along the deep grooves 25D. It will be understood that the cam teeth 30C and rotary cam 30 are then caused to be moved rearward by the force of the spring *7a* to the position shown in FIG. 8 when the knob 9 is released.

Figure 11:
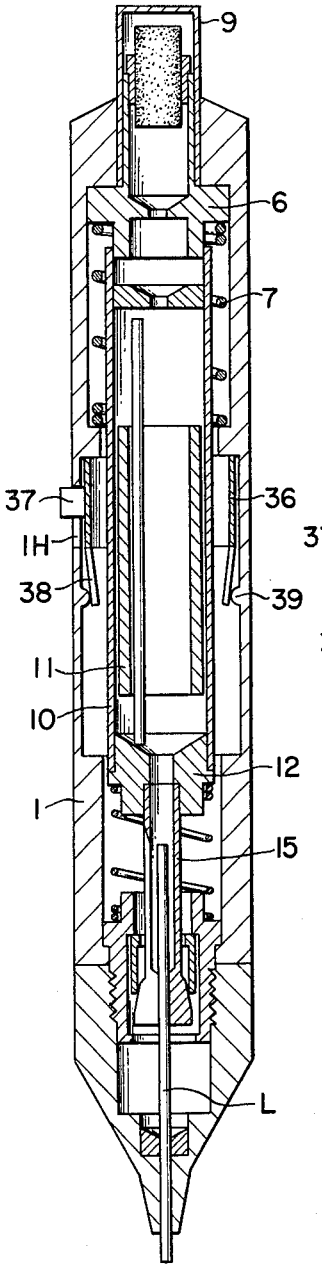
FIG. 11 is a view similar to FIG. 1 showing still another example of the pencil according to the invention having a manipulable mechanism for holding and locking the lead-feeding mechanism.
Figure 12:
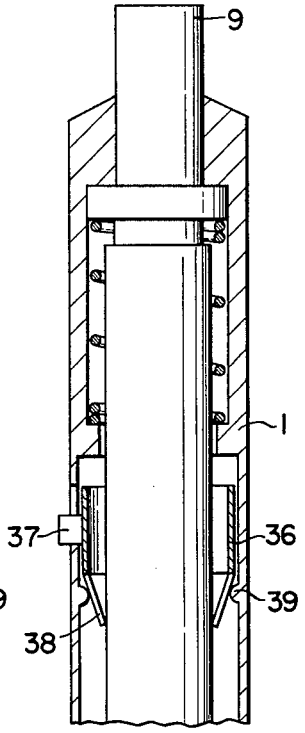
FIG. 12 is a partial similar view showing the same pencil with the above mentioned manipulable mechanism in its holding and locking state.

In the pencil illustrated in FIG. 11, a sliding sleeve 36 having a manipulating button 37 projecting out of the cylinder 1 through a slot 1H formed therein is provided in the cylinder 1, and spring leaf parts 38 are connected to the sleeve 36 so as to be located around the lead reservoir 10. Projections 39 projecting inward from the wall of holder cylinder 1 is in contact with the outer faces of the spring leaf parts 38, which, when the button 24 is pressed forward, presses against and holds the central lead-feeding mechanism as shown in FIG. 12. The button 24 is then abuttingly engaged with front edge of the slot 1H, whereupon the lead-feeding mechanism is locked in position so as to cause the chuck 15 to spread open to prevent feeding of the lead L. In this pencil, the weight 11 is provided not around the lead reservoir 10 but within the reservoir to prevent its interference with the spring leaf parts 38 disposed outside the reservoir.

Thus, in the mechanical pencil of this invention as described above, the bothersome manipulations for feeding the lead in known types of mechanical pencils such as the rotating types and the knocking types are eliminated, and replenishment of the lead as it wears through writing can be accomplished with an extremely simple and natural motion without any change in the writing attitude of the pencil which has once been set in the writing hand.

I claim:

1. In a mechanical pencil having a barrel or holder cylinder with a front writing end provided with a hollow nose piece, the combination therewith of a pencil lead feeding device disposed within the holder cylinder and comprising:

a lead holder supported by the nose piece and functioning to lightly hold a lead piece passed therethrough;

a tubular lead reservoir for storing therein lead pieces to be successively fed forward;

a chuck having a wedge-shaped head part for clamping a lead piece therein, said chuck being fixed at the rear end thereof to the front part of the lead reservoir;

a tightening ring associated with said head part to constrict by wedge action and release said head part respectively upon the head part being pressed relatively rearward thereagainst and pulled relatively forward away therefrom thereby to cause the head part respectively to clamp and release a lead piece from said reservoir, said tightening ring being movable in the longitudinal direction of the holder cylinder between front and rear stop means integral with the holder cylinder;

said reservoir, chuck and tightening ring constituting a lead-feeding mechanism movable in the longitudinal direction of the holder cylinder;

a front spring compressively installed with an installation load of the order of 200 grams or less to urge said lead-feeding mechanism rearward into a normal position at which said head part of the chuck is pressed against the tightening ring abutted against and stopped by said rear stop means; and a weight being movable in said longitudinal direction and associated with said lead reservoir to apply a forward inertia force thereto when a forward shake is imparted to the holder cylinder, whereupon said inertia force moves said lead-feeding mechanism forward overcoming the force of the front spring, said head part thereby being moved forward relative to the tightening ring upon the ring striking and being stopped by said front stop means, the head part thereby releasing the lead piece and continuing to move further forward until the lead-feeding mechanism is stopped by a stop part integral with the holder cylinder, the lead-feeding mechanism then being returned to said normal position, whereby at each instance of said forward shake imparted to the holder cylinder, a lead piece being held by the chuck is fed forward.

2. The combination as claimed in claim 1 in which said chuck is fixed to said reservoir through a connector having a central through hole for passage of a lead piece therethrough.

3. The combination as claimed in claim 2 in which said weight is of tubular shape and is disposed in a longitudinally slidable state around the lead reservoir.

4. The combination as claimed in claim 3 in which said connector is formed with an abutment flange against which the weight collides when a forward shake is imparted to the holder cylinder, and the holder cylinder is provided with an eraser rubber holder at the rear end thereof, said holder having therewithin a front cylindrical part against which the weight collides, and in which said weight is provided with shock-absorbing means on its front and rear ends, and said abutment flange and said front cylindrical part are also provided with shock-absorbing means thereby to reduce vibration and noise arising from the lead-feeding action.

5. The combination as claimed in claim 3 in which said connector is formed with an abutment flange against which the weight strikes as a result of its momentum when a forward shake is imparted to the holder cylinder.

6. The combination as claimed in claim 1 in which said weight is secured to a part of the lead-feeding mechanism.

7. The combination as claimed in claim 1 in which said lead reservoir is formed to function doubly as said weight.

8. The combination as claimed in claim 1 in which said lead reservoir has at the rear end thereof a stopper having a small through hole for supplying lead pieces therethrough into the reservoir and functioning to reduce longitudinal movement of the lead pieces.

9. The combination as claimed in claim 1 in which the holder cylinder is provided at its rear end with an eraser rubber holder which holds an eraser rubber projecting rearwardly out through a hole at the rear end of the holder cylinder.

10. The combination as claimed in claim 9 in which the holder cylinder is closed at its rear end with a rear plug secured thereto and having said hole, and said eraser rubber holder is held in abutting contact with the rear plug by rearwardly directed force of a rear spring compressively installed within the holder cylinder.

11. The combination as claimed in claim 10 in which said eraser rubber holder has a front cylindrical part in which the rear end of the lead reservoir is inserted slidably.

12. The combination as claimed in claim 11 in which said front cylindrical part is so formed as to serve as abutment means for limiting rearward movement of the weight.

13. The combination as claimed in claim 1 in which said weight is provided on its front and rear ends with shock-absorbing members thereby to reduce vibration and noise arising from the lead-feeding action.

14. The combination as claimed in claim 1, further comprising abutment means integral with the holder cylinder, against which abutment means said lead-feeding mechanism collides when the forward shake is imparted to the holder cylinder, said abutment means being so positioned as to stop the lead-feeding mechanism before said front spring is fully compressed and before said chuck head part collides against said nose piece or lead holder.

15. The combination as claimed in claim 1, further comprising means for causing said chuck head part to become inoperative to clamp a lead piece while the pencil is not in use.

16. The combination as claimed in claim 1, further comprising means for preventing the lead-feeding mechanism from moving in the longitudinal direction of the holder cylinder while the pencil is not in use.

17. The combination as claimed in claim 1 in which a guide tube is fixed to said nose piece at a position in front of and coaxial with said lead holder, extending forward beyond the front extremity of the nose piece, and is adapted to guide a projected lead piece and to protect the same from breakage.

18. The combination as claimed in claim 1 in which said lead holder is supported by a hollow slide member slidable in said nose piece in said longitudinal direction, and a guide tube is fixed at its rear end to the front part of the slide member at a position coaxial with the lead holder, the guide tube, together with the slide member and lead holder, being normally in a rearwardly retracted position and being thrust forward by a forward feeding movement of a lead piece to extend forward beyond the front extremity of the nose piece thereby to guide and protect the projected lead piece.

* * * * *